United States Patent [19]

Hamada

[11] Patent Number: 4,757,701

[45] Date of Patent: Jul. 19, 1988

[54] SIX STAGE ROLLING APPARATUS FOR FORMING ENDLESS METAL BELTS

[75] Inventor: Koichi Hamada, Tokyo, Japan

[73] Assignee: Ishibashi Iron Works, Co., Ltd., Ohsaka, Japan

[21] Appl. No.: 55,467

[22] Filed: May 28, 1987

[30] Foreign Application Priority Data

May 29, 1986 [JP] Japan ..... 61-124033

[51] Int. Cl.[4] ..... B21B 5/00

[52] U.S. Cl. ..... 72/110; 82/111; 82/422

[58] Field of Search ..... 72/105, 106, 110, 111, 72/422

[56] References Cited

U.S. PATENT DOCUMENTS 2,917,100 12/1959 Sharpe ..... 72/105

3,505,848 4/1970 Jones, Sr. ..... 72/110

FOREIGN PATENT DOCUMENTS 199635 11/1983 Japan ..... 72/422

*Primary Examiner*—Lowell A. Larson

*Attorney, Agent, or Firm*—Arnold S. Weintraub

[57] ABSTRACT

A six stage rolling machine for forming endless metal belts from tubular workpieces comprises, a first roll disposed within the workpiece, a second roll disposed outside the workpiece and constitutes, in cooperation with the first roll, a pair of work rolls for effecting one position rolling of the tube into a belt. The first roll is provided with a pair of back-up drive rolls capable of being contacted with the first roll under pressure to play a role as backing up and driving rolls, similarly, the second roll is also provided with a pair of rolls capable of being contacted with the second roll under pressure to play a roll as backing up and driving rolls, that is, the rolling machine comprises a pair of work rolls and four back-up rolls, that is, six rolls in total. The front side of the machine body at one axial end of the first roll and the side from which the finished belt is discharged are open and contiguous and are exposed to the outside the rolling machine, moreover, the portions adjacent these areas are provided with respective subsidiary means, namely, a feeder in which a supply of workpieces waiting rolling are stored and a delivery member for sending out the product belts are disposed, in addition, there is also disposed, at the front of the machine, a transfer means which transfers the workpieces from the feeder to the first roll and finished belts from the first roll to the delivery member.

7 Claims, 7 Drawing Sheets

SIX STAGE ROLLING APPARATUS FOR FORMING ENDLESS METAL BELTS

BACKGROUND OF THE INVENTION

Field of the Invention

This invention relates to a rolling apparatus for rolling tube material stocks by using one or more six stage rolling machines to form endless metal belts used for power transmission by automobile engines, electric motors, or driving force transmitting means for precision machine, facsimiles, X-Y plotters, measuring instruments or the like.

The rolling apparatus of the present invention comprises a first roll and a second roll constituting a pair of work rolls, and two pairs of back-up rolls each pair of which backs up and drives each work roll, thus having six rolls in total (so comprehensively called six stage roll), which the wall of a tubular workpiece is roller between the pair of work rolls to deform the tube material stock into a elongated belt whose length is progressively increased to a desired length based on the principle that the total volume of the material under plastic deformation does not vary due to the extent of deformation.

Prior Art

Heretofore, there has been provided such a six stage rolling machine as disclosed by Japanese Utility Model Publication No. 58(1983)-56001. This prior art rolling machine is a type which rolls a tube of metal stock by a so-called six stage rolling machine comprising a first roll and a second roll both constituting together a pair of work rolls, each of which is equipped with a pair of rolls acting as both driving and back-up rolls. These two pairs of driving and back-up rolls are supported by two separate roll housings and the distance between the two housings can be varied so that the tube material stock can be mounted on the first roll for rolling purpose and the rolled product belt can be removed from the first roll by merely moving one of the housings in such a manner that the distance between the two housings is increased.

However, in the conventional six-stage rolling machine of the type described above, the front side in the direction of the axis of the first roll and the front part of the discharging side from which the rolled belt extends are covered by the lower part of the housing of the back-up rolls, as a consequence, feeding of the tube material stock to the first roll and removing the rolled product belt have been done manually.

Therefore, the rolling operation requirement of manual handling limits the efficiency of the operation.

SUMMARY OF THE INVENTION

The present invention overcomes the drawbacks mentioned above, and enables both the feeding of tubular workpieces to the first roll and the subsequent removal of the rolled belts in the so-called six stage belt rolling machine to be automated to improve the efficiency of the rolling operation.

A six stage rolling machine for making endless metal tubes according to the present invention comprises, a first roll which is engaged with the interior of a tubular workpiece, a second roll which engages the outside of the tubular workpiece and constitutes, in cooperation with the first roll, a pair of work rolls for rolling the workpiece into a belt. The first roll is provided with a pair of back-up drive rolls capable of engaging the first roll under pressure to act as backing up and driving rolls, similarly, the second roll is also provided with a pair of rolls capable of engaging the second roll under pressure to act as backing up and driving rolls, that is, the rolling machine comprises a pair of work rolls and four back-up drive rolls, that is, six rolls in total.

According to the present invention, the front side of the machine in the direction of the axis of the first roll and the side in the direction of discharging the extending belt under rolling, are open and contiguous. A feeder in which a number of tubular workpieces awaiting rolling are stored and a delivery member for discharging the product belts are disposed, adjacent the open sides of the machine as is at a transfer means which transfers a workpiece from the feeder to the first roll and simultaneously transfers the formed belt from the first roll to the delivery member after the workpiece has been rolled.

At the beginning, the back-up rolls of the first roll and the back-up rolls of the second roll are spaced apart at a predetermined distance, and both the back-up rolls to be contacted with the first roll and the second roll are positioned being spaced apart from the first roll, under this condition, the first workpiece in the feeder is transferred onto the first roll by the transfer means. The second roll is then urged under pressure against the first roll to clamp the wall of the workpiece and the respective back-up rolls are engaged under pressure with the first roll and second roll, respectively, and workpiece is rolled between the first and second rolls.

Since the rolling is conducted to increase the length of the periphery of the rolled belt without accompanying any change in the total volume of the workpiece, the workpiece will be pushed out from the first roll to extend in a specific direction. The extended belt so being formed by the rolling operation, if required, can be further extended by imparting tension by means of a tension roll applied to the inner wall of the extended belt. In this manner the rolling can be finished when the peripheral length of the belt has reached the selected length after the back-up rolls of both the first roll. When the second roll has been retracted from the first roll, the transfer means will grip the formed belt and transfer it to the delivery member, at the same time, the next workpiece is transferred from the feeder to the first roll.

Because the front side of the machine body in the direction of the axis of the first roll and the side from which the formed belt is discharged are open being contiguous throughout these two areas and are exposed outside the rolling machine, feeding of workpieces and discharge of formed belts can be performed by automated transfer means.

BRIEF DESCRIPTION OF THE DRAWINGS

FIG. 5(*b*) is a cross sectional view taken along line B—B of FIG. 4;

DETAILED DESCRIPTION OF THE PREFERRED EMBODIMENTS

Figure 1:
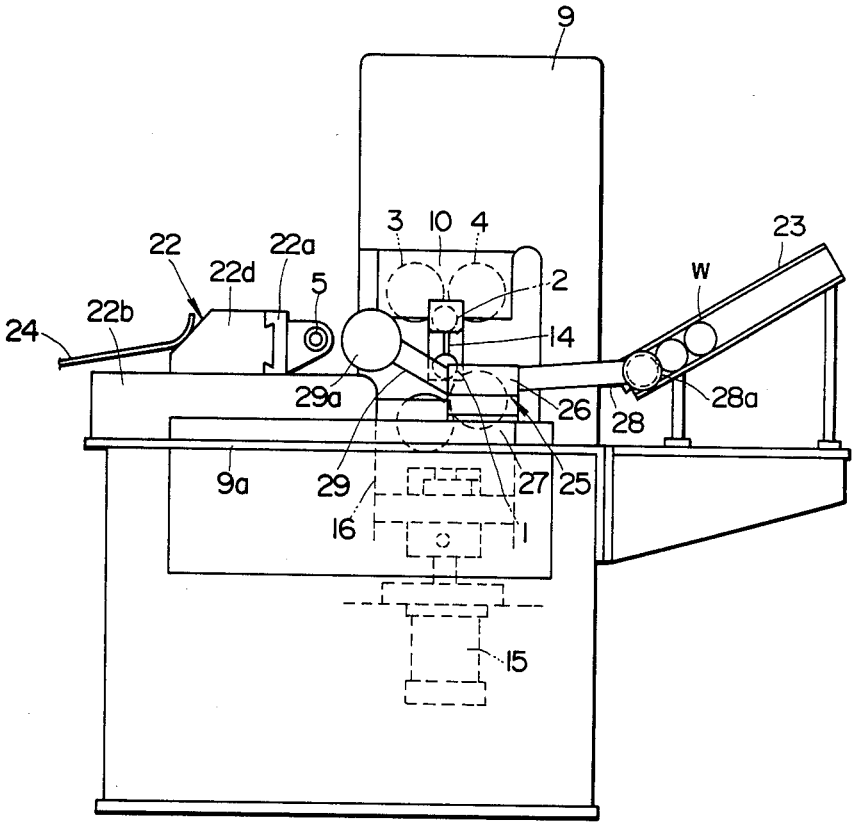
FIG. 1 is a front view of a preferred embodiment of the present invention.
Figure 2:
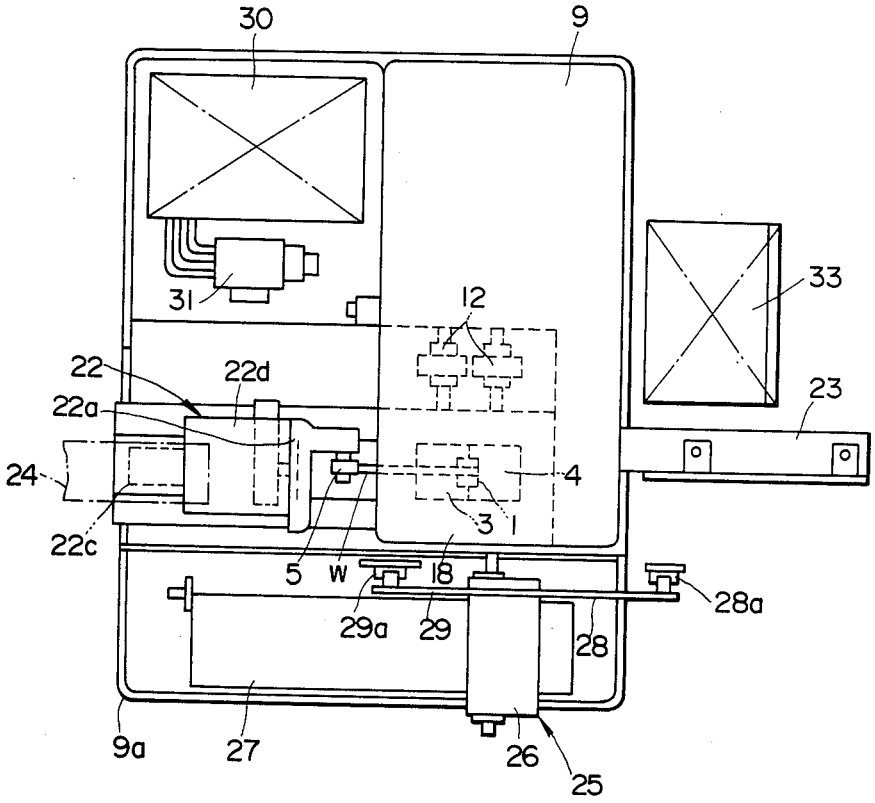
FIG. 2 is a plan view showing the embodiment shown by FIG. 1.
Figure 3:
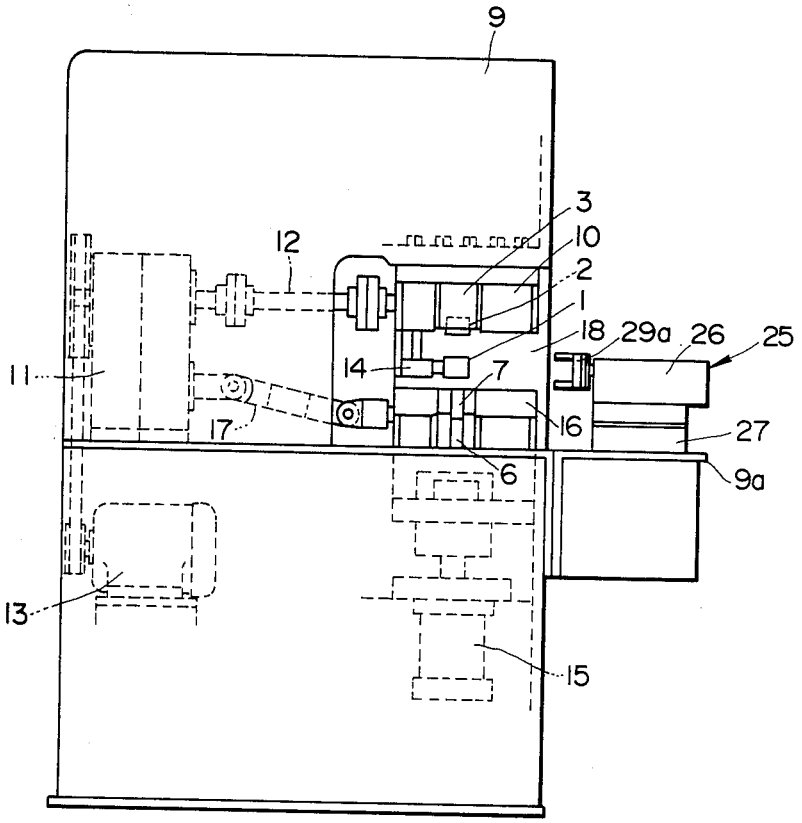
FIG. 3 is a left side view of the same embodiment.

Drawings FIG. 1 and the drawings subsequent thereto shown a preferred embodiment of this invention, particularly FIGS. 1 through 3 indicate entire rolling machine for making endless metal belts. A pair of work rolls include a first roll 1 dimensioned to be inserted inside a tubular workpiece W and a second roll 2 located to be disposed outside the workpiece W during subsequent rolling steps so as to effect rolling down of the tube material stock at one position. The first roll is associated with a pair of back-up rolls 6 and 7 which can be pressed against the first roll to impart both driving and supporting action to first roll 1. Second roll 2 is engaged by a pair of back-up rolls 3 and 4 which can impart both driving and supporting action to second roll 2. In this way, six rolls, namely, the pair of work rolls 1 and 2 together with four back-up rolls 3, 4, 6 and 7 are disposed in the rolling machine 9.

The back-up rolls 3 and 4 are rotatably mounted in the frame of rolling machine 9 as by a bearing housing 10 and a motor 13 is operable to drive back-up rolls 3 and 4 in rotation via roller gears 11 and a rotary shaft 12. The first roll 1 is rotatably supported in rolling machine 9 by a lifting device 14 so as to be lifted or lowered, while the back-up rolls 6 and 7 are mounted in the rolling machine 9 by a housing 16 capable of being raised or lowered by a hydraulic cylinder 15 and are coupled to the roller gears 11 via a rotary shaft 17 equipped with a universal joint.

Figure 4:
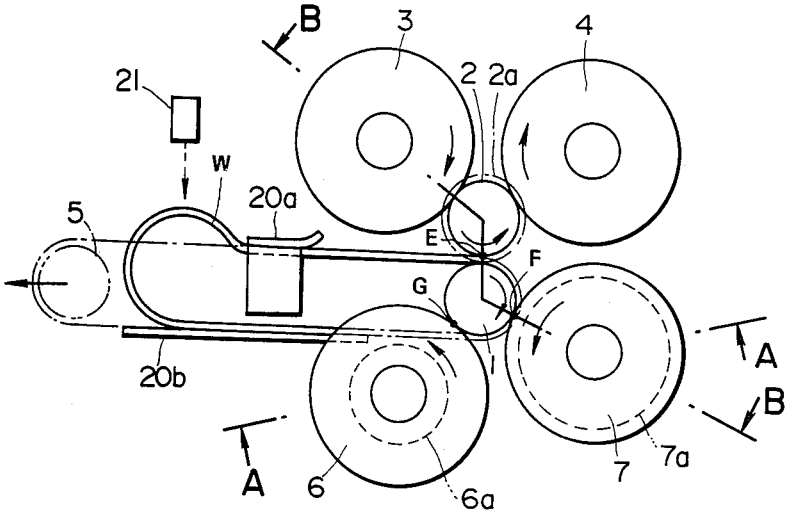
FIG. 4 is a schematic side view showing the rolling of the tube.
Figure 5A:
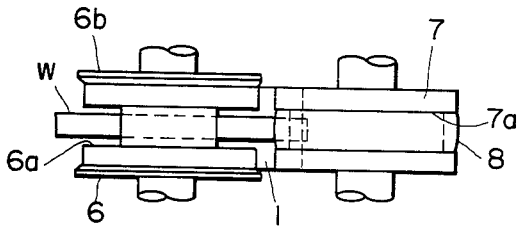
FIG. 5(*a*) is a cross sectional view taken along line A—A of FIG. 4.
Figure 5B:
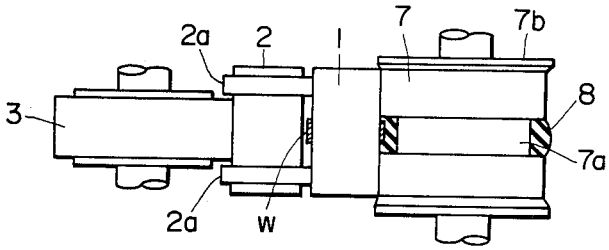

The operating relationship rolls 1, 2, 3, 4, 5 and 6 is depicted in detail in FIG. 4, but this relationship is well known, and the workpiece W to be rolled down at one position between the first roll 1 and the second roll 2 will be extended leftward by the rolls 1 and 2 as shown in FIG. 4. According to this embodiment, the outer peripheral surface of back-up roll 7 is formed with an annular groove 7*a*, into which an elastic member 8 is fitted. Elastic member 8 is made of a rubber-like elastomer such as urethane rubber and its outer surface projects radially outwardly beyond its both side faces, thereby the elastic member prevents wavy advancing of the extended belt under rolling by the centering action, and at the same time, makes the extended part of the workpiece proceed in the direction mentioned above and shown in FIG. 4, by imparting tensile force to the belt W at the portion F forward in the direction of proceeding of the belt and adjacent to the rolling position E. The back-up roll 7 contacts the first roll at its axial opposite ends and acts to support and drive the first roll 1.

A pair of annular rubber-like elastic members 2*a* are fitted around the outer peripheral face of the second roll 2 at each lateral side thereof.

Elastic members 2*a* are projected radially beyond the outer periphery of second roll 2 and the extent of this radial projection exceeds the thickness of the tube or belt to be worked, so there still remains rolling force between the two work rolls 1 and 2 after they have finished the rolling operation, but they will not impart any rolling force to the worked belt. The periphery of the back-up roll 6 is formed with an annular groove 6*a* such that the back-up roll 6 and workpiece W do not interfere with each other.

In addition, a pair of flanges 6*b* and 7*b* are formed on both lateral sides of each of the two back-up rolls 6 and 7, thereby the side shift between the rolls 6 and 7 and the first roll 1 can be prevented.

An upper guide 20*a* for guiding the belt being formed from workpiece W against upward and transverse movement and a lower guide 20*b* against its downward movement are provided at the portion of the rolling machine in the advancing direction of the worked metal belt (FIG. 4). The length of the belt being formed is sensed by a sensor 21. As soon as the length of the worked belt sensed by the sensor reaches a pre-determined length, a tension roll 5 is advanced axially inside the loop of the extended belt W and then moved in a direction tensioning the belt.

In the drawings, 22*a* is a sliding table for so moving tension roll 5 and forms a part of a tension imparting means 22. The sliding table 22*a* is received by a movable block 22*d* which similarly forming a part of the tension imparting means 22, in a manner so as to be slidably moved in the axial direction of the tension roll 5, and the movable block 22*d* is slidably received by a bed 22*b* as shown in FIGS. 1 and 2. Connected to the bed 22*b* is a hydraulic cylinder 22*c* for slidably moving the movable block 22*d*. On the movable block 22*d* or at a portion adjacent thereto, a means for sensing the peripheral length of the loop of the belt under rolling is disposed, though such a sensing means is not depicted in the drawings.

The front side of the first roll 1 in the rolling machine 9 in its axial direction and also the front side of the belt in the direction of its extension are open. The portion shown by a numeral 18 is the opened space in the rolling machine. Also the portion at the left of the roll 1 of the rolling machine 9 (left side part of the first roll 1 shown in FIGS. 1 and 2) is also open to allow the belt being stretched to be extended leftwards.

A feeder 23 is disposed at the front right side of the rolling machine 9, so as to store the workpieces W to be rolled. The feeder 23 is inclined with its forward portion facing the rolling machine 9 and is formed to receive a plurality of tubular workpieces W. At the front left side of the machine 9 a delivery member 24 for sending out the end product belts W is located and takes the form of an inclined chute 24 which transfer the product W laid thereon to another place. The central front portion of the rolling machine 9 is provided with a transfer means 25 which transfers the workpieces W from feeder 23 to the first roll 2 and also transfers the formed belt from the roll 1 to the delivery member 24. The transfer means 25 is mounted on the apron 9*a* of the rolling machine, and includes a transfer carriage 26 movable rightward and leftward relative to the rolling machine, a bed 27 carrying the transfer carriage 26 on the apron 9*a*, a feeding arm 28 for transferring a workpiece W from the feeder 23 onto the roll 1, a delivery arm 29 for transferring the formed belt from the first roll 1 to the delivery member 24 and a driving means for actuating the both arms 28 and 29 in a synchronized manner.

The transfer means 25 is actuated by a sensor, not shown in the drawings, which detects the length of the periphery of a formed belt under rolling and sends a signal to actuate the transfer means 25 when the belt has just reached the predetermined length by the rolling of the workpiece W conducted between the first roll 1 and the second roll 2.

A pair of gripping means 28a and 29a are disposed on the forward tip end of the feeder arm 28 and the transfer arm 29, respectively. Each gripping means is operable to grip each workpiece W and a product belt W. For this purpose, each gripping means is provided with gripping finger for catching the tube material stock and the product belt.

Each of the gripping means 28a or 29a simultaneously grips the workpiece or formed belt, respectively, at the portion shown in FIGS. 1 and 2, and transfers the gripped article leftward by movement of the transfer carriage 26, thereby the tube material stock W in the feeder 23 is carried to the first roll 1 as the formed belt is carried from roll 1 to the delivery member 24.

Thus the gripping means 28a and 29a has another function, in addition to the lateral movement as shown in FIGS. 1 and 2, to advance axially toward or retract from the workpiece W from the positions confronting with the feeder 2, the first roll 1 and the delivery member 24.

The gripping members 28a and 29a function to grip and transfer the workpiece or the formed belt, so they are constructed to hold the gripped piece during their transferring.

Alternatively, they can be constructed to perform their transferring action by means of swing motion instead of lateral movement by such a transfer carriage as shown in the aforesaid example.

Numerals 30, 31 and 33 in the drawings denotes a hydraulic pressure system such as oil pressure unit, pressure source such as an oil pump or a control panel board, respectively.

Next, explanation will be made of the sequence of rolling endless metal belts in accordance with the preferred embodiment by referring to FIGS. 6 through 17. In explaining the operation, the tube or belt of metal W is denoted different reference symbols, that is, the tubular workpiece prior to rolling is denoted as $W_1$, the belt during rolling as $W_2$ and the product belt which has been rolled down to the desired peripheral length is denoted as product $W_3$.

Figure 6:
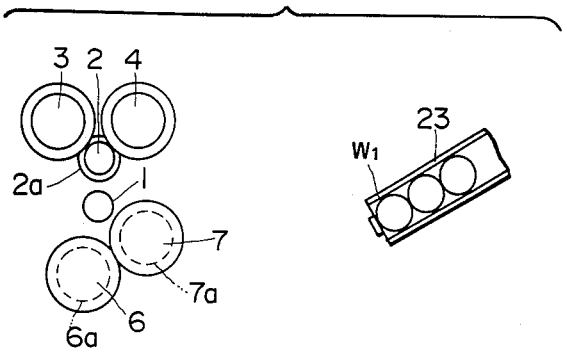
FIG. 6 through FIG. 17 are views showing the sequence of rolling operation.

Step 1 (FIG. 6)

As a first step, back-up rolls 6 and 7 and the first roll 1 of the rolling machine of the device for making endless metal belts are lowered to provide clearance around the first roll 1 as shown in FIG. 6.

Figure 7:
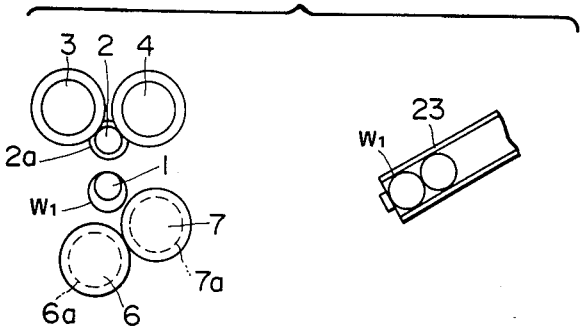

Step 2 (FIG. 7)

Next, the transfer means 25 is actuated and the end tubular workpiece $W_1$ in the feeder 23 is gripped by the gripping member 28a as shown by FIG. 7. Transfer carriage 26 is then moved leftward as shown in FIG. 2. When the transfer carriage has reached to the end point of movement, the gripping member 28 is placed at a position corresponding to the first roll 1.

Next movement of the feeding arm 28 in a direction axially advances the gripped workpiece onto the first roll 1.

Figure 8:
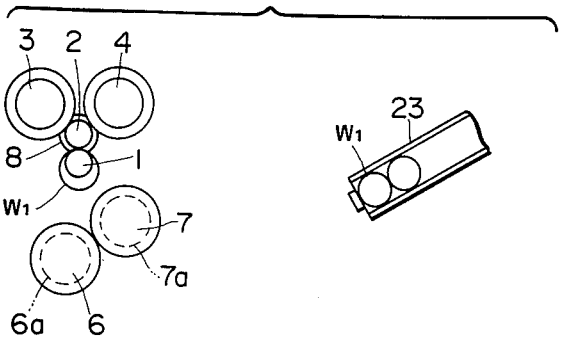

Step 3 (FIG. 8)

Next the first roll 1 is raised upward to the rolling position, where the workpiece $W_1$ is clamped between the first roll 1 and the second roll 2.

Figure 9:
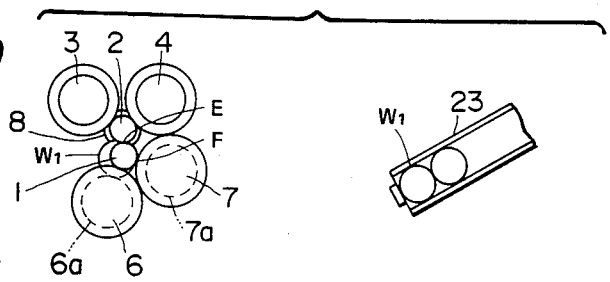

Step 4 (FIG. 9)

Then the back-up rolls 6 and 7 are raised upward, whereby the subsequent rotation of all the back-up rolls 3, 4, 6 and 7 initiates backing up and driving of the first roll 1 and second roll 2 accompany rolling of the workpiece $W_1$.

Figure 10:
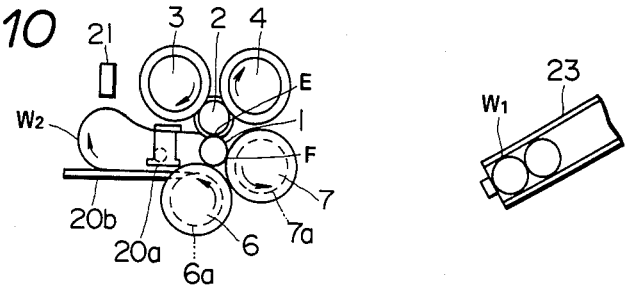

Step 5 (FIG. 10)

As the rolling operation proceeds, periphery of the tube $W_1$ is lengthened to become a looped belt $W_2$. Since the elastic member 8 of the back-up roll 7 imparts tensional force to the looped belt $W_2$ and urges it out leftward shown in the drawing, the belt $W_2$ deforms upward, corresponding to the increased peripheral length, accompanying leftward extension of the belt $W_2$ under rolling. The portion of the belt $W_2$ under deformation is guided both at its upside and downside limits and rightside and leftside limits by the guides 20a and 20b, thereby the advancing direction of the forward portion of the belt is specifically limited. By sensing the tip end of the deformed portion of the belt under rolling the sensor 21, the sensor is able to determine whether the peripheral length of the belt $W_2$ has reached the predetermined value or not.

Figure 11:
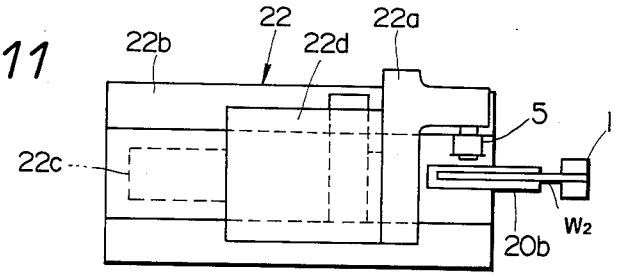

Step 6 (FIG. 11)

When the extension of the belt $W_2$ reaches the sensor, the tension roll 5 is axially aligned with the left-hand light of the deformed belt $W_2$. This drawing is a plan view.

Figure 12:
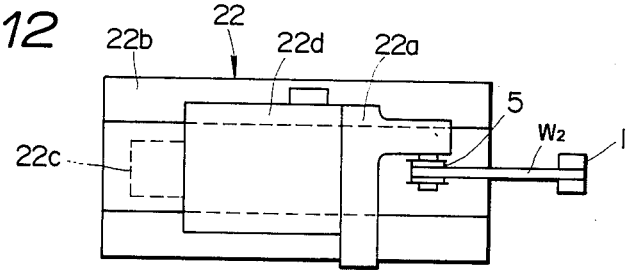

Step 7 (FIG. 12)

When the peripheral length of the belt $W_2$ has reached the predetermined value, the tension roll 5, disposed on the sliding member 22a of the tension imparting means 22, is advanced axially into the light of belt $W_2$, then the sliding table 22a is moved leftward by the hydraulic cylinder 22c as shown in FIGS. 1, 2 and 12, to apply a tensile force to the belt $W_2$ while rolling of belt $W_2$ by the first roll 1 and the second roll 2 is continued.

Figure 13:
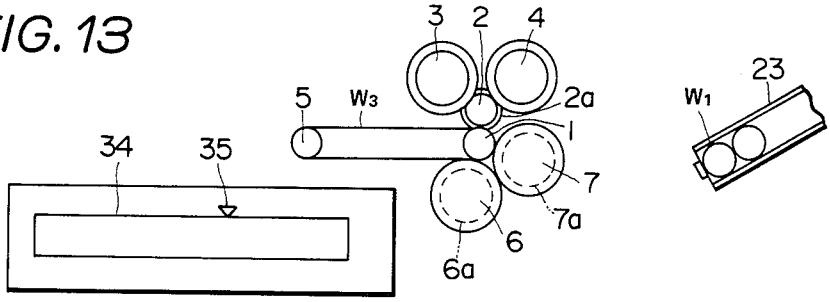

Step 8 (FIG. 13)

Numeral 34 in this drawing is an indicator for detecting the length of the inner periphery of the rolled belt $W_2$ and the 35 is a mark indicating the desired finished length. The belt $W_2$ being rolled by the first roll 1 and the second roll 2 while being tensioned by the tension roll 5, is detected by indicator 34, that is, when the belt $W_2$ is rolled down to have the predetermined inner peripheral length, a specific point of the indicator 34 is set to come on the mark 35 and this means that the belt $W_2$ has been deformed to a finished belt $W_3$ of the desired length. A signal for actuating the transfer means 25 is issued by this detection. The way to detect whether the specific point of the sliding table 22a arrives at the mark 35 is made automatically by means of a known sensor. In this drawing, the tension imparting means itself is not depicted.

Figure 14:
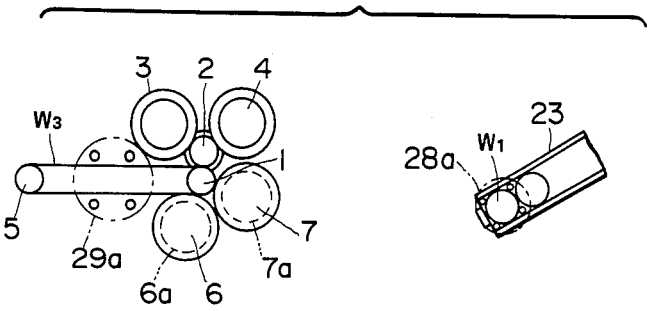

Step 9 (FIG. 14)

All the back-up rolls 3, 4, 6 and 7 are stopped at this stage, thus the first roll 1 and the second roll 2 also stop rotation. At this instance, the transfer carriage 26 of the transfer means 25 is moved to the right side end shown in FIGS. 1 and 2, at the same time, feeder arms 28 and 29 also move together, thereby the respective gripping portion 28a and 29a are advanced to grip the tube material stock $W_1$ and product belt $W_3$, respectively.

Figure 15:
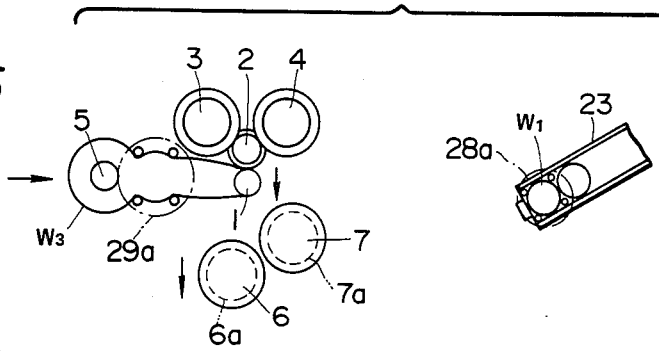

Step 10 (FIG. 15)

The slidable carriage 22a of the tension imparting means 22 moves toward the first roll 1 and relates the tension imparted to the product belt $W_3$, then the belt product $W_3$ apts to become a circular ring due to its own elasticity so as to be grasped by the gripping portion 29a, while another gripping portion 28a grips tube material stock $W_1$.

Figure 16:
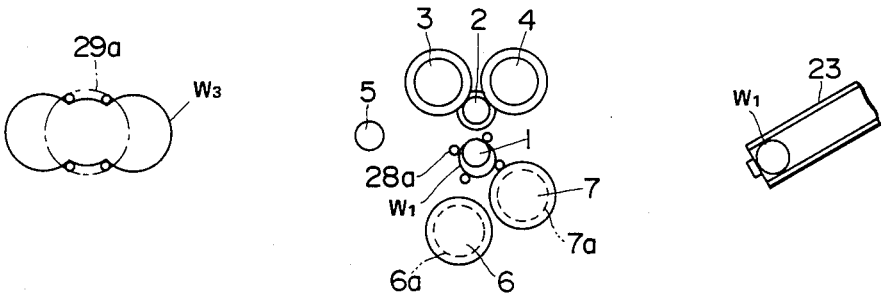

Step 11 (FIG. 16)

The transfer carriage 26 travels to the left end of its stroke, while the respective gripping portions 28a, 29a still grip the workpiece $W_1$ and product tube $W_3$. At the position to which the transfer carriage 26 has moved, the gripping portion 28a confronts with the first roll 1 and the gripping portion 29a is placed above the delivery member 24.

Figure 17:
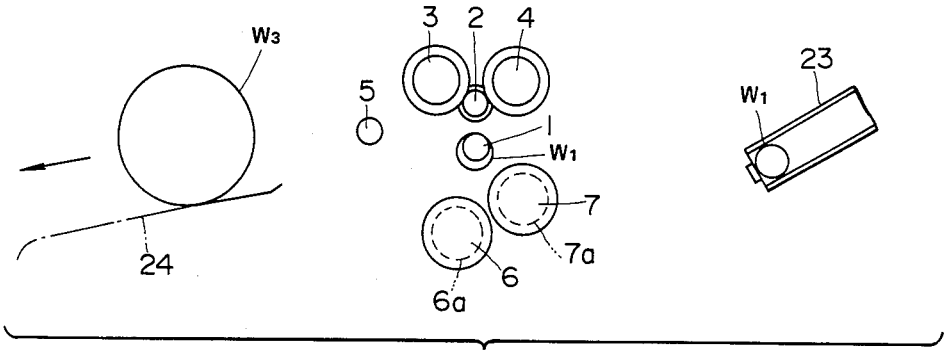

Step 12 (FIG. 17)

The product tube $W_3$ is dropped onto the delivery member 24 and the workpiece $W_1$ is advanced onto the first roll 1. Such a series of operational steps are repeated over and over again to successively roll a number of tubular workpieces $W_1$ into as many product belts.

The product belt $W_3$ may be made either as final product or as semi-products to be subsequently rolled further into endless belts of desired size.

In this embodiment, feeder 23 and delivery member 24 are shown as using inclined passages, however, the feeder 23 may be of other construction so long as the workpiece $W_1$ in the forefront always comes to the same position, similarly, the delivery member 24 also can be made in many other form provided that it can deliver the product tube $W_3$ to next station. Where it is required to apply successive reduction of tube material stock by installing in series a plurality of six stage roll stands as explained above and supplying rolled belt worked by one rolling machine to subsequent rolling machine so as to make the peripheral length of the belt longer one after another, the delivery member 24 of one rolling machine can be coupled to the feeder 23 of the next roll stand or the delivery member 24 is formed to act a role both as delivery member 24 of one rolling machine also as a feeder of next rolling machine.

Needless to say each step of operation in the above-mentioned embodiment can be controlled relying either on a sequential controlling circuit or on computerized manner of control.

As explained above with respect to the preferred embodiment of the present invention, workpieces awaiting rolling are successively fed one after another to the first roll, where the workpiece is subjected to rolling in a six stage rolling machine at one position defined between the first roll and the second roll until it is rolled down to a product belt having a preselected peripheral length. Thereafter, the transfer means transfers the product belt to the delivery member, while the next workpiece is simultaneously fed to the first roll, in this way, feeding and discharge to and from the first roll is accomplished by means of the transfer means. Accordingly, feeding of workpieces to the first roll, and transferring and discharge of the rolled product belt can be made in automatic manner which achieves a rolling operation with reduced man hours and high efficiency.

What is claimed is:

1. In a six stage rolling machine for rolling a tubular workpiece of a first internal diameter into a endless belt of a second internal diameter substantially greater than said first internal diameter, said machine including a pair of work rolls mounted for movement about spaced parallel axes and for movement relative to each other between a retracted position radially spaced from each other and a rolling position wherein the wall of a tubular workpiece surrounding one of said work rolls is radially compressed between said work rolls, said one of said work rolls having an outer diameter less than said first internal diameter, back-up drive roll means associated with each of said work rolls operable to drive said work rolls in rotation to roll and circumferentially expand a workpiece compressed between said work rolls;

the improvement comprising feeder means for storing tubular workpieces to be rolled at a location at one side of said work rolls, delivery means for discharging endless belts rolled from the opposite side of said work rolls, transfer means mounted on said machine for movement along a path normal to the axes of said work rolls and extending between a first end limit and a second end limit, first means on said transfer means operable when said transfer means is at its first end limit to grip and remove a workpiece from said feeder means and operable when said transfer means is at said second end limit of movement to place the workpiece upon said one of said work rolls, and second means on said transfer means operable when said transfer means is at said first end limit for removing a rolled endless belt from said one of said work rolls and operable when said transfer means is at said second end limit for discharging a rolled endless belt onto said delivery means.

2. The invention defined in claim 1 further comprising sensing means for detecting the internal diameter of said endless belt as said belt is being rolled by said work rolls and for generating a signal upon detecting when said belt has been rolled to said second internal diameter, and means responsive to said signal for controlling operation of said backup drive roll means and said transfer means.

3. The invention defined in claim 1 wherein said back-up drive roll means compises a first roll associated with said one of said work rolls, said first roll having a resilient member extending around its periphery tangentially engageable with a portion of said endless belt moving away from the grip of said work rolls during the rolling of said belt for applying tension to said belt.

4. The invention defined in claim 3 wherein said first roll includes a pair of opposite axial end sections in frictional rolling engagement with said one of said work rolls, and means between said axial end sections defining an annular groove in the periphery of said first roll, said resilient member being fitted into said annular groove.

5. The invention defined in claim 3 or claim 4 wherein said resilient member projects radially outwardly beyond the periphery of said first roll.

6. The invention defined in claim 1 wherein said back-up drive roll means comprises a first and a second roll each having peripheral portions engageable with circumferentially spaced points on the periphery of said one of said work rolls for driving said one of said work rolls in rotation, that one of said first and second rolls located downstream of the other with respect to the direction of movement of said belt during rolling of said belt having a peripheral groove for receiving said belt to prevent interference between said belt and said one of said first and second rolls.

7. The invention defined in claim 6 further comprising radially projecting flange means at the axially opposite ends of said one of said first and said second rolls engageable with said one of said work rolls to axially locate said one of said rolls relative to said one of said work rolls.

* * * * *